US006260955B1

(12) United States Patent
Sundström

(10) Patent No.: US 6,260,955 B1
(45) Date of Patent: Jul. 17, 2001

(54) PRINTING APPARATUS OF TONER-JET TYPE

(75) Inventor: Per Sundström, Järfälla (SE)

(73) Assignee: Array Printers AB, Vastra Frolunda (SE)

( * ) Notice: Subject to any disclaimer, the term of this patent is extended or adjusted under 35 U.S.C. 154(b) by 0 days.

(21) Appl. No.: 09/142,669

(22) PCT Filed: Mar. 11, 1997

(86) PCT No.: PCT/SE97/00414

§ 371 Date: Sep. 11, 1998

§ 102(e) Date: Sep. 11, 1998

(87) PCT Pub. No.: WO97/34203

PCT Pub. Date: Sep. 18, 1997

(30) Foreign Application Priority Data

Mar. 12, 1996 (SE) ..... 9600946

(51) Int. Cl.[7] ..... B41J 2/06
(52) U.S. Cl. ..... 347/55
(58) Field of Search ..... 347/55, 151, 120, 347/141, 154, 103, 123, 111, 159, 177, 128, 131, 125, 158; 399/271, 290, 292, 293, 294, 295; 216/4, 48

(56) References Cited

U.S. PATENT DOCUMENTS

| | | |
|---|---|---|
| 3,566,786 | 3/1971 | Kaufer et al. . |
| 3,689,935 | 9/1972 | Pressman et al. . |
| 3,725,898 | 4/1973 | Canton . |
| 3,779,166 | 12/1973 | Pressman et al. . |
| 3,815,145 | 6/1974 | Tisch et al. . |
| 3,831,165 | 8/1974 | Chivian et al. . |
| 3,877,008 | 4/1975 | Payne . |
| 4,263,601 | 4/1981 | Nishimura et al. . |
| 4,274,100 | 6/1981 | Pond . |

(List continued on next page.)

FOREIGN PATENT DOCUMENTS

| | | |
|---|---|---|
| 12 70 856 | 6/1968 | (DE) . |
| 26 53 048 | 5/1978 | (DE) . |
| 0345 024 A2 | 6/1989 | (EP) . |

(List continued on next page.)

OTHER PUBLICATIONS

"The Best of Both Worlds," Brochure of Toner Jet by Array Printers, The Best of Both Worlds, 1990.
International Congress on Advances in Non–Impact Printing Technologies, 1994, pp. 311–313.
E. Bassous, et al., "The Fabrication of High Precision Nozzles by the Anisotropic Etching of (100) Silicon", J. Electrochem. Soc.: Solid–State Science and Technology, vol. 125, No. 8, Aug. 1978, pp. 1321–1327.

*Primary Examiner*—John Barlow
*Assistant Examiner*—Raquel Yvette Gordon
(74) *Attorney, Agent, or Firm*—Knobbe, Martens, Olson & Bear, LLP

(57) ABSTRACT

A printing apparatus includes heat treatment means, a rotatable feeder roll chargeable to a predetermined first potential, a support roll chargeable to a predetermined second potential, and a matrix in the form of a flexible printing circuit. The matrix has supply apertures, each supply aperture having a first inner diameter and being surrounded by an electrically conducting control ring configured to be charged to a predetermined third potential and having a second inner diameter. The third potential is selected to control corresponding supply apertures between an open state and a closed state. The first inner diameter of the control ring is at least equal to the second inner diameter of the supply aperture. The matrix and the electrically conducting control rings are covered on upper surfaces and aperture edges with an electrically insulating layer. The feeder roll, the support roll and the matrix are configured to transfer a dry powder from the feeder roll through the supply apertures of the matrix to an object to be printed which is conveyed over the support roll. The powder deposited on the object is fixed by the heat treatment means.

16 Claims, 2 Drawing Sheets

U.S. PATENT DOCUMENTS 4,307,169 12/1981 Matkan .
4,320,408 3/1982 Iwasa et al. .
4,340,893 7/1982 Ort .
4,353,080 10/1982 Cross .
4,382,263 5/1983 Fischbeck et al. .
4,384,296 5/1983 Torpey .
4,386,358 5/1983 Fischbeck .
4,442,429 4/1984 Kotani et al. .
4,470,056 9/1984 Galetto et al. .
4,478,510 10/1984 Fujii et al. .
4,491,855 1/1985 Fujii et al. .
4,498,090 2/1985 Honda et al. .
4,511,907 4/1985 Fukuchi .
4,525,727 6/1985 Kohashi et al. .
4,546,722 10/1985 Toda et al. .
4,571,601 2/1986 Teshima .
4,610,532 9/1986 Schamphelaere et al. .
4,611,905 9/1986 Schamphelaere et al. .
4,675,703 6/1987 Fotland .
4,717,926 1/1988 Hotomi .
4,743,926 5/1988 Schmidlin et al. .
4,748,453 5/1988 Lin et al. .
4,814,796 3/1989 Schmidlin .
4,831,394 5/1989 Ochiai et la. .
4,860,036 8/1989 Schmidlin .
4,896,184 1/1990 Kamitamari et al. .
4,903,050 2/1990 Schmidlin .
4,912,489 3/1990 Schmidlin .
5,028,812 7/1991 Bartky .
5,036,341 7/1991 Larsson .
5,038,159 8/1991 Schmidlin et al. .
5,040,000 8/1991 Yokoi .
5,049,469 9/1991 Pierce et al. .
5,057,855 10/1991 Damouth .
5,072,235 12/1991 Slowik et al. .
5,073,785 12/1991 Jansen et al. .
5,083,137 1/1992 Badyal et al. .
5,095,322 3/1992 Fletcher .
5,121,144 6/1992 Larson et al. .
5,128,662 7/1992 Failla .
5,128,695 7/1992 Maeda .
5,148,595 9/1992 Doggett et al. .
5,153,093 10/1992 Sacripante et al. .
5,170,185 12/1992 Takemura et al. .
5,181,050 1/1993 Bibl et al. .
5,193,011 3/1993 Dir et al. .
5,204,696 4/1993 Schmidlin et al. .
5,204,697 4/1993 Schmidlin .
5,214,451 5/1993 Schmidlin et al. .
5,229,794 7/1993 Honman et la. .
5,235,354 8/1993 Larson .
5,237,346 8/1993 Da Costa et al. .
5,256,246 10/1993 Kitamura et al. .
5,257,045 10/1993 Bergen et al. .
5,270,729 12/1993 Stearns . .
5,274,401 12/1993 Doggett et al. .
5,287,127 2/1994 Salmon .
5,305,026 4/1994 Kazuo et al. .
5,307,092 4/1994 Larson .
5,311,266 5/1994 Madea .
5,316,806 * 5/1994 Yoshinaga et al. .
5,328,791 7/1994 Ohta .
5,329,307 7/1994 Takemura et al. .
5,374,949 12/1994 Wada et al. .
5,386,225 1/1995 Shibata .
5,402,158 3/1995 Larson .
5,414,500 5/1995 Furukawa .
5,438,437 8/1995 Mizoguchi et al. .
5,446,478 8/1995 Larson .
5,450,115 9/1995 Bergen et al. .
5,453,768 9/1995 Schmidlin .
5,473,352 12/1995 Ishida .
5,477,246 12/1995 Hirabayashi et al. .
5,477,250 12/1995 Larson .
5,506,666 4/1996 Masuda et al. .
5,508,723 4/1996 Maeda .
5,510,824 4/1996 Nelson .
5,515,084 5/1996 Larson .
5,523,827 6/1996 Snelling et al. .
5,526,029 6/1996 Larson et al. .
5,558,969 9/1996 Uyttendaele et al. .
5,559,586 9/1996 Wada .
5,600,355 2/1997 Wada .
5,614,932 3/1997 Kagayama .
5,617,129 4/1997 Chizuk, Jr. et al. .
5,625,392 4/1997 Maeda .
5,629,726 * 5/1997 Yasama ..... 347/55
5,640,185 6/1997 Kagayama .
5,650,809 7/1997 Kitamura .
5,666,147 9/1997 Larson .
5,677,717 10/1997 Ohashi .
5,708,464 1/1998 Desie .
5,729,817 3/1998 Raymond et al. .
5,774,153 6/1998 Kuehnle et al. .
5,774,159 6/1998 Larson .
5,786,838 7/1998 Steinhaser et al. .
5,801,729 9/1998 Kitamura et al. .
5,805,185 9/1998 Kondo .
5,818,480 10/1998 Bern et al. .
5,818,490 10/1998 Larson .
5,847,733 12/1998 Bern .
5,850,244 * 12/1998 Leonard et al. ..... 347/141
5,850,588 12/1998 Yoshikawa .
5,867,191 2/1999 Luque .
5,874,973 2/1999 Wakahara .
5,889,542 3/1999 Albinsson .
5,905,516 5/1999 Kagayama .
5,956,064 9/1999 Sandberg .
5,959,648 9/1999 Albinsson .
5,963,767 10/1999 Habets et al. .
5,966,151 * 10/1999 Wakahara ..... 347/55
5,966,152 10/1999 Albinsson .
5,971,526 10/1999 Klockar .
5,975,683 11/1999 Smith et al. .
5,984,456 11/1999 Bern .

FOREIGN PATENT DOCUMENTS 0 323 143 A2 7/1989 (EP) .
0352 997 A2 1/1990 (EP) .
0377 208 A2 7/1990 (EP) .
389 229 9/1990 (EP) .
0660 201 A2 6/1995 (EP) .
0703 080 A2 3/1996 (EP) .
0715 218 A1 6/1996 (EP) .
072 072 A2 7/1996 (EP) .
0736 822 A1 10/1996 (EP) .
0 743 572 A1 11/1996 (EP) .
0 753 413 A1 1/1997 (EP) .
0752 317 A1 1/1997 (EP) .
0764 540 A2 3/1997 (EP) .
0 795 792 A1 9/1997 (EP) .
0816 944 A1 1/1998 (EP) .
0 844 095 A3 5/1998 (EP) .
2108432 5/1983 (GB) .
4426333 11/1969 (JP) .
5555878 4/1980 (JP) .
584671 6/1980 (JP) .
5587563 7/1980 (JP) .
5689576 7/1981 (JP) .
58044457 3/1983 (JP) .
58155967 9/1983 (JP) .

| | | |
|---|---|---|
| 62-248662 | 10/1987 | (JP) . |
| 6213356 | 11/1987 | (JP) . |
| 01120354 | 5/1989 | (JP) . |
| 05220963 | 8/1990 | (JP) . |
| 04189554 | 8/1992 | (JP) . |
| 4-268591 | 9/1992 | (JP) . |
| 4282265 | 10/1992 | (JP) . |
| 05131671 | 5/1993 | (JP) . |
| 5208518 | 8/1993 | (JP) . |
| 93331532 | 12/1993 | (JP) . |
| 858143 | 8/1994 | (JP) . |
| 94200563 | 8/1994 | (JP) . |
| 06344587 | 12/1994 | (JP) . |
| 7246717 | 9/1995 | (JP) . |
| 9048151 | 2/1997 | (JP) . |
| 09118036 | 5/1997 | (JP) . |
| 9014960 | 12/1990 | (WO) . |

* cited by examiner

PRINTING APPARATUS OF TONER-JET TYPE

FIELD OF THE INVENTION

The present invention generally relates to a printing apparatus of the type which is used in various types or printers, in copying machines, in telefax machines etc., and which operates using a dry toner (colour powder) which is by an electrical process applied to the object to be printed, for instance the paper, and which is fixed to the paper, generally by a heat treatment.

BACKGROUND OF THE INVENTION

The invention is more particularly directed to a printing apparatus of said type, which is named a "toner-jet" printing apparatus, and in which a dry colour powder, generally named "toner", is, by a direct method, transferred from a rotating toner feeder roll, through apertures of a fixed matrix in the form of a flexible printing circuit and to the object to be printed, for instance the paper, which is moved over a support roll, and in which the toner received on the paper is finally fixed on the paper by a heat treatment.

The principle of said process is that there are created two electric fields for transferring the toner from the feeder roll to the paper, a first electric field between the toner feeder roll and the toner matrix, which field can be brought to invert its polarity, and a second electric field, preferably a constantly downwards directed positive electric field between the matrix and the support roll over which the paper is conveyed.

The toner matrix is formed with a large number of very narrow, through apertures having a diameter of for instance 100–300 $\mu$m, and around each such aperture an electrically conducting ring of a suitable metal, for instance copper, in the following referred to as "copper ring". Each copper ring is arranged so that a positive potential, for instance +300 V, can be impressed thereto, which potential is higher than the potential of the feeder roll, which can be for instance between +5 and +100 V, preferably about +50 V, but which is lower than the potential of the support roll for the paper, which can be for instance +1500 V. The electrically conducting ring, when impressed with a voltage, makes the belonging matrix aperture become "opened" for letting through toner. If, on the contrary, the matrix aperture is given a potential which is substantially less than the potential of the toner feeder roll, for instance if it is connected to earth the belonging matrix aperture becomes "closed" thereby preventing toner from passing down through said aperture.

The function is as follows:

- the colour powder (toner) gets a negative potential in that the toner particles are rubbed against each other;
- the toner is supplied to the toner feeder roll, which has a positive charging of a predetermined potential, often a potential which can be varied between +0 and +100 V, and the toner is spread in an even, suitably thick layer on the feeder roll by means of a doctor blade;
- each aperture of the matrix which corresponds to a desired toner point is opened in that the matrix aperture ring is impressed by a positive potential which is higher that the potential of the feeder roll, for instance +300 V; apertures corresponding to non-toner-carrying portions remain connected to earth, which means that said apertures are to be considered as "closed" and that they thereby make it impossible for toner to pass said apertures; the combination of opened matrix apertures create a sign to be imaged;
- depending on the difference in potential, for instance +50 V to +300 V=+250 V between the feeder roll and the toner matrix the negatively charged toner particles are sucked down from the feeder roll to the matrix, and depending on the difference in potential between the toner matrix and the support roll mounted underneath same, for instance +300 V to +1500 V=+1200 V toner particles are moved from the matrix and deposit on the paper conveyed over the support roll;
- the paper having toner deposited thereon is finally moved through a heat treatment apparatus in which the toner is fixed to the paper.

There is an almost linear relationship between the current density and the traction force that the electric field exerts on the toner particles. The greatest density of the field is located very close above the copper rings and the density decreases in the direction towards the centre of the aperture. By reducing the potential of the feeder roll and thereby increasing the difference in potential between the feeder roll and the matrix it is possible to increase the amount of toner which is allowed to pass same; an increase of the potential of the feeder roll provides a corresponding reduction of the amount of toner which is let through.

By connecting a copper ring of the matrix to earth the direction of potential is inverted between the feeder roll from having been +250 V in the direction downwards to be +50 V in the direction upwards, and this makes negatively charged toner particles stick to the feeder roll, or makes such particles become sucked back thereto, respectively.

In a particular embodiment of a printing apparatus the distance between the feeder roll and the matrix was adjusted to about 0.1 mm, and the distance between the matrix and the support roll to about 0.6 mm. For the above mentioned potentials, which are given as examples, this gives a field strength of 2.5 V/$\mu$m, which is higher that the insulation property of air, which is about 1 V/$\mu$m. For eliminating the risque of flash-over between the feeder roll and the copper ring of the matrix and between the copper ring and the support roll it is therefore necessary that the matrix aperture ring be insulated.

In printing apparatus of toner-jet type, so far known, the copper rings have been insulated by being "baked into" (embedded in) the matrix material, and therefore the inner diameter of the copper ring of the matrix aperture has been made greater than the diameter of the matrix aperture, and an insulation material has been applied so as to cover all sides of the matrix. For a matrix aperture having a diameter of for instance 190 $\mu$m the inner diameter of the copper ring was made 250 $\mu$m. This means that the matrix aperture for letting toner down has a surface which is only 57.8% of the surface inside the copper ring, and the aperture for letting toner through is located some distance radially inside the inner diameter of the copper ring, where the field density is highest and should have given maximum force for sucking toner down. As a consequence there is a highly restricted degree of toner supply.

SUMMARY OF THE INVENTION

The object of the invention therefore is to solve the problem of providing a printing apparatus of toner-jet type having a substantially increased capacity of letting toner down than what is possible with the above discussed previously known printing apparatus.

This problem is solved in that the diameter of the toner aperture is made at least nearly as wide as the inner diameter of the charged copper ring, whereby the copper ring might be used to a maximum for moving toner from the feeder roll, through the matrix and down to the paper. The copper rings preferably are mounted directly on top of the matrix base in which the matrix apertures are drilled, and the matrix apertures thereby get the same diameter as the inner diameter of the copper rings. As mentioned above it is necessary, however, that the copper rings always are insulated, and according to the invention the charged copper rings are fixed mounted on top of the matrix base so that the matrix apertures and the copper rings extend edge to edge, and that the entire matrix is coated for instance by an evaporation method, with an insulation material which covers all free surfaces and the edges of the matrix, the matrix apertures and the copper rings. A available method is the method named the Parylene® method (Union Carbide) according to which a polymeric insulation material, poly-para-xylene, is applied to the matrix in a vacuum apparatus in layers having a well controlled thickness. The material has an electrical degradation resistance of about 200 V/$\mu$m. This means that it should be sufficient to make use of a layer having a thickness of only 2 $\mu$m for insulating an electric field having a voltage of +250 V between the toner feeder roll and the copper ring of the matrix.

DETAILED DESCRIPTION OF THE PREFERRED EMBODIMENTS

Figure 1:
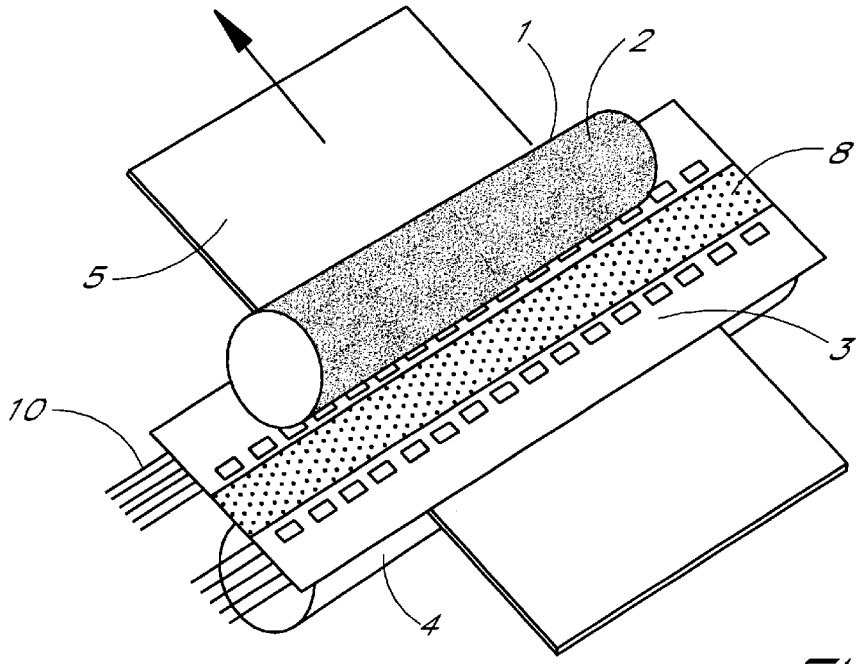
FIG. 1 shows schematically and in a perspective view the basic principle of a printing apparatus of toner-jet type.

Thus, in FIG. 1 is diagrammatically shown a printing apparatus of toner-jet type comprising a toner feeder roll 1 having a layer 2 of toner (colour powder) of known type thereon, a toner matrix 3 mounted underneath said feeder roll 1, and a support roll 4 mounted underneath the matrix 3 over which an object to be printed is moved, that is between the matrix and the support roll. Said object normally is a paper 5.

Figure 2:
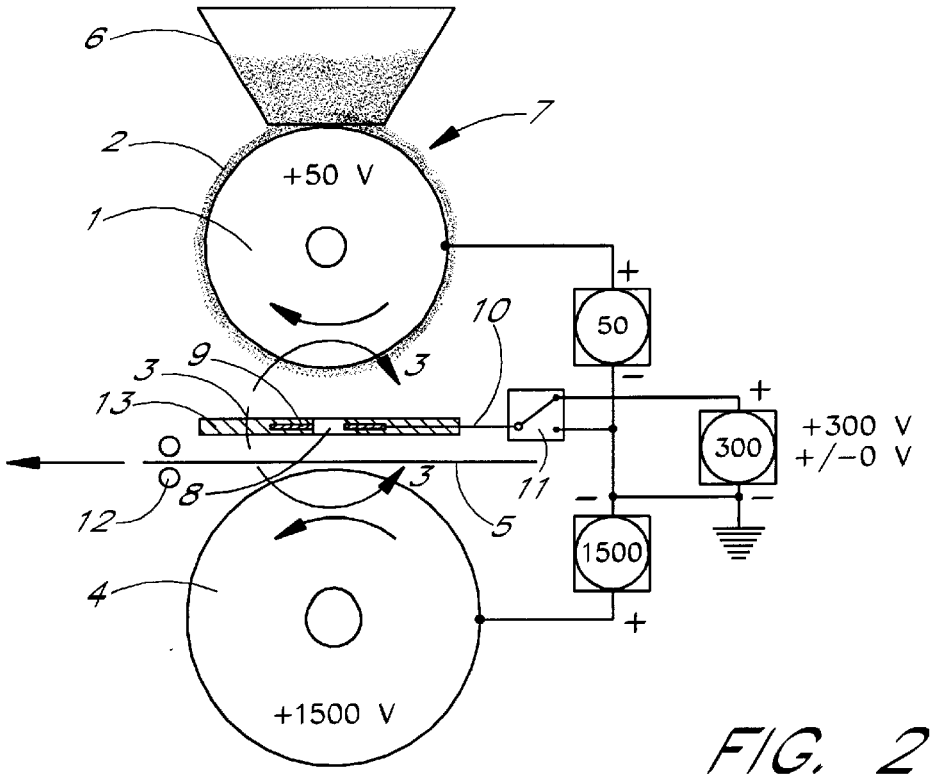
FIG. 2 (PRIOR ART)
FIG. 2 shows schematically a cross section view through a printing apparatus of toner-jet type according to known techniques.

As shown in FIG. 2 a toner container 6 is mounted above the rotating feeder roll 1, and from said container 6 toner is let down on the feeder roll 1. A doctor blade 7 spreads and distributes the toner to an even layer of toner 2 on the feeder roll 1. A certain positive voltage of for instance between +5 and +100 V is applied to the feeder roll, in the illustrated case a voltage of about +50 V. Since the toner particles rub each other they are charged with a negative polarity and this makes the toner particles become sucked to the feeder roll which is charged with a positive polarity.

The matrix 3 is formed with a large number of through apertures 8 adapted to let toner through when said apertures are in "open" condition. The apertures may have a diameter of 100–300 $\mu$m. An electrically conducting ring 9 of for instance copper is mounted around each toner aperture 8 for controlling the letting down of toner particles. Each copper ring 9, or control ring, is over conduits 10 electrically connected to a control means 11 diagrammatically shown in FIG. 2 arranged for alternatively impressing a voltage on the copper ring which is higher than the voltage of the feeder roll 1, for instance a voltage of +300 V, whereby the matrix aperture is "opened", or for connecting the copper ring to a voltage which is lower than the voltage of the feeder roll, especially a voltage of +0 V in that the ring 9 is connected to earth, whereby the matrix aperture is "closed".

Thus, the opening of the toner matrix aperture 8 is made in that the copper ring 9 is given a potential of for instance +300 V, whereby there will be a difference of potential of +300−+50=+250 V between the toner feeder roll 1 and the matrix 3. Said difference of potential is so great that the toner particles having a negative charge are let free from the toner feeder roll 1 and are sucked down to the matrix 3 and through the open matrix apertures 8. When the copper ring is connected to earth the direction of potential is inverted and there is an upwards directed difference of potential of +50 V, and toner particles thereby are sucked back to the toner feeder roll 1 and are kept thereon.

The support roll 4 is constantly impressed with a voltage which is higher than the highest voltage of the matrix, which is +300 V. In the illustrated case said support roll is given a voltage of +1500 V. When the matrix apertures 8 are "opened" there will be a downwards directed difference of potential of +1200 V, and said difference makes toner particles become sucked down from the matrix 3 to the support roll 4. Toner particles deposit as dots of toner on the paper 5 which is conveyed above the support roll 4. A series of such dots from several matrix apertures 8 successively form the image or images to be printed on the paper.

The paper 5 with the toner particles let down thereon thereafter pass through a heat treatment apparatus, for instance between two heater rolls 12, between which rolls the toner powder becomes fixed on the paper.

The distances between the different parts marked in the drawings are strongly exaggerated for the sake of clearness. The actual distance between the toner feeder roll 1 and the matrix 3 can be, for instance, 0.1 mm and the distance between the matrix and the support roll 4 can be, for instance, 0.6 mm.

Figure 3:
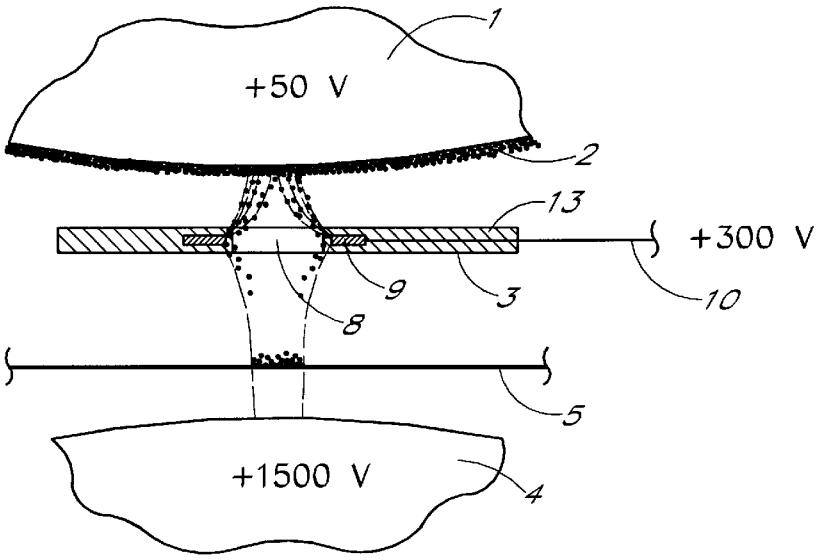
FIG. 3 (PRIOR ART)
FIG. 3 shows in an enlarged scale the an encircled part of FIG. 2.

As mentioned above, and as illustrated in FIG. 3 (prior art) the copper rings 9, which are arranged to open the toner feeder apertures 8 of the matrix 3, have to be insulated for avoiding flash-over to the toner feeder roll 1 and to the support roll 4, respectively. In prior art printers the copper rings generally were embedded in an insulating material. This has as an effect that the inner diameter of the copper rings 9 will be substantially less than the diameter of the toner apertures 8 of the matrix. Said toner apertures 8 of the matrix thereby can have a diameter of for instance 190 $\mu$m, whereas the inner diameter of the copper ring 9 is 250 $\mu$m. This means that the matrix aperture 8 for letting toner through has an area which is only 57.8% of the inner area of the copper ring 9. This is not good, in particular not considering the fact that the electric field density has a top adjacent the inner diameter of the copper ring 9. For this reason the capacity of letting toner through is highly restricted. In FIG. 3 the density of electric field is marked with the dotted lines.

Figure 4:
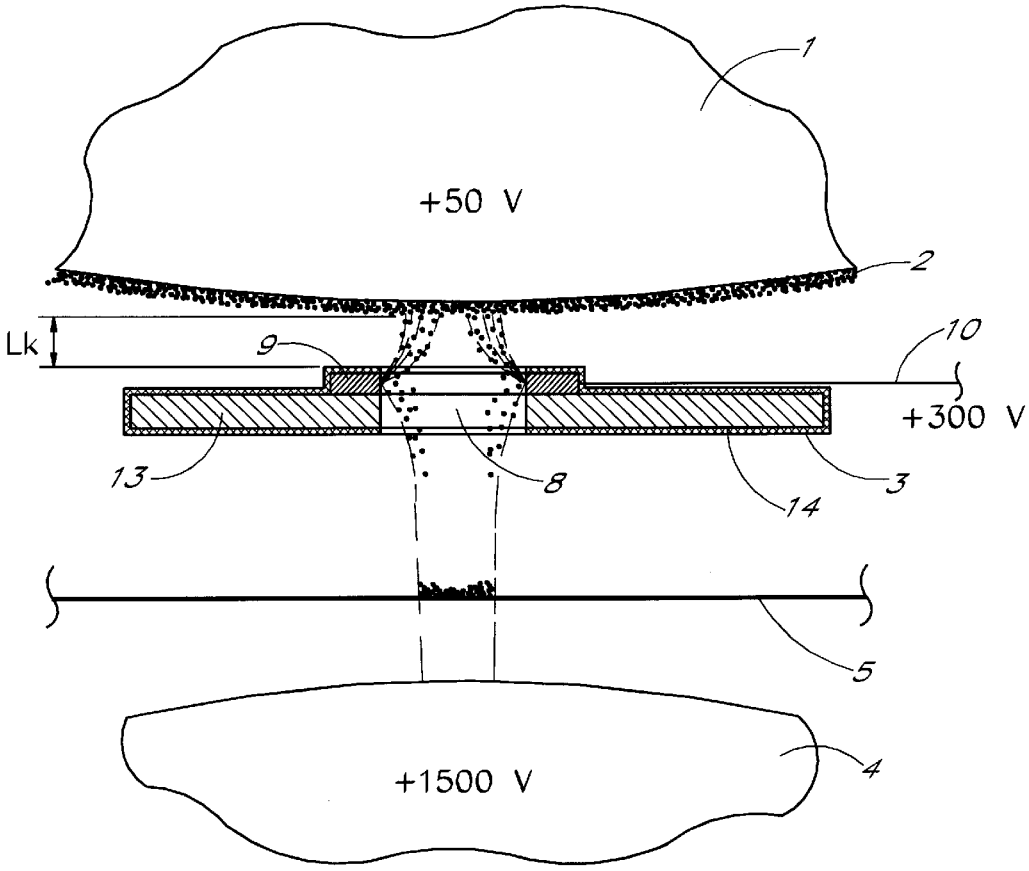
FIG. 4 shows, similar to FIG. 2, the printing apparatus in accordance of the invention.

For increasing the capacity of letting toner through the apertures of the matrix it is therefore desired that the inner diameter of the copper ring 9 is the same, or almost the same as the diameter of the matrix toner aperture 8, since the copper ring 9 can in such case be used to a maximum for transferring toner from the feeder roll 1, through the matrix 3 and down to the paper 5. The copper rings 9 preferably are mounted directly on top of the matrix base 13 in which the matrix apertures are drilled, and the matrix apertures 8 thereby get the same diameter as the inner diameter of the copper rings 9, as shown in FIG. 4.

As mentioned above the copper rings 9, however, always must be insulated for avoiding flash-over, and according to the invention the electrically conducting copper rings 9 are fixedly connected in a suitable way on top of the matrix base, for instance by means of glue or tape, so that the matrix aperture 8 and the copper ring 9 with the inner diameters thereof extend edge to edge. Thereafter the entire matrix 3 is coated with a thin insulating layer 14 which covers the entire matrix at the upper surface and the bottom surface thereof and which is also applied to the inner edges both of the matrix apertures 8 and the copper rings 9. Such a coating may, for instance, be made by an evaporation method using an insulating material which encloses all free surfaces of the matrix, the matrix apertures-and the copper rings. An presently available method is the method named the parylene® method (Union Carbide), according to which a polymeric insulation material named poly-para-xylene is applied to the matrix in very well predetermined thick layers using an evaporation apparatus. The material has a resistance against electric degradation of about 200 V/$\mu$m. This means that it should be sufficient to make use of an insulation layer 14 having a thickness of only 2 $\mu$m for insulating an electric field of 250 V between the toner feeder roll 1 and the copper ring 9 of the matrix. To be sure the insulating layer can be applied in a thickness of 5–10 $\mu$m. Even for such great thickness of the insulating layer as 10 $\mu$m, whereby the diameter the matrix toner let through aperture is 170 $\mu$m, for a copper ring 9 having a diameter of 190 $\mu$m, the specific let through opening for toner in the matrix is 89.8% as compared with the inner surface of the copper ring 9, to be compared with the prior art case in which the inner diameter of the copper ring is 250 $\mu$m giving a specific opening surface of 57.8%. According to the invention the specific opening surface for letting toner through the matrix is 32% greater than that of the prior art printing apparatus, and this gives a greater margin in the printing with the printing apparatus and a more even print quality can be obtained. At the same time problems depending on varying moisture and temperature of the ambient air are reduced. Thanks to the increased degree of colour density of the print it is also possible reduce the drive voltage of the control rings 9 and to increase the tolerances of certain means included in the apparatus.

| REFERENCE NUMERALS |
|---|
| 1 toner feeder roll |
| 2 toner layer |
| 3 toner matrix |
| 4 support roll |
| 5 paper |
| 6 toner container |
| 7 doctor blade |
| 8 toner supply aperture |
| 9 copper ring |
| 10 conduit (for 9) |
| 11 control means |
| 12 heater roll |
| 13 matrix base |
| 14 insulation layer |

What is claimed is:

1. A printing apparatus comprising:

heat treatment means;

a rotatable feeder roll chargeable to a predetermined first potential;

a support roll chargeable to a predetermined second potential; and a matrix in the form of a printing circuit, said matrix having supply apertures, each supply aperture having a first inner diameter and being surrounded by an electrically conducting control ring configured to be charged to a predetermined third potential and having a second inner diameter, said third potential being selected to control corresponding supply apertures between an open and closed state, said open state being achieved when said third potential is higher than said first potential and lower than said second potential, and said closed state being achieved when said third potential is lower than said first potential, said second inner diameter of the control ring being at least equal to the first inner diameter of the supply aperture, said matrix and said electrically conducting control rings being covered on upper surfaces and aperture edges with an electrically insulating layer;

wherein said feeder roll, said support roll and said matrix are configured to transfer a dry powder from said feeder roll through said supply apertures of the matrix to an object to be printed which is conveyed over said support roll, said powder deposited on the object being fixed by said heat treatment means.

2. The printing apparatus of claim 1, wherein each electrically conducting control ring is connected directly to a base of said matrix with the second inner diameter of the control ring edge to edge with the supply aperture of the matrix.

3. The printing apparatus of claims 2, wherein the electrically insulating layer is a layer of a polymeric material.

4. The printing apparatus of claim 3, wherein the polymeric material is poly-para-xylene applied in a layer having a predetermined thickness.

5. The printing apparatus of claim 3, wherein the insulating material of the matrix is applied by an evaporation method.

6. A printing apparatus of comprising:

heat treatment means;

a rotatable feeder roll chargeable to a predetermined first potential;

a support roll chargeable to a predetermined second potential; and a matrix in the form of a printing circuit, said matrix having supply apertures, each supply aperture having a first inner diameter and being surrounded by an electrically conducting control ring configured to be charged to a predetermined third potential and having a second inner diameter, said third potential being selected to control corresponding supply apertures between an open and closed state, said open state being achieved when said third potential is higher than said first potential and lower than said second potential, and said closed state being achieved when said third potential is lower than said first potential, said second inner diameter of the control ring being at least equal to the first inner diameter of the supply aperture, wherein each electrically conducting control ring is connected directly to a base of said matrix with the second inner diameter of the control ring edge to edge with the supply aperture of the matrix, said matrix and said electrically conducting control rings being covered on upper surfaces and aperture edges with an electrically insulating layer, wherein the electrically insulating layer is a layer of polymeric material applied by an evaporation method and has an electric degradation resistance of about 200 V/μm and is applied in a layer of more than 2 μm for insulating an electric field of +250 V between the feeder roll and the control ring of the matrix;

wherein said feeder roll, said support roll and said matrix are configured to transfer a dry powder from said feeder roll through said supply apertures of the matrix to an object to be printed which is conveyed over said support roll, said powder deposited on the object being fixed by said heat treatment means.

7. The printing apparatus of claim 6, wherein the layer is between 5–10 μm.

8. The printing apparatus of claim 2, wherein the insulating material of the matrix is applied by an evaporation method.

9. A printing apparatus of comprising:

heat treatment means;

a rotatable feeder roll chargeable to a predetermined first potential;

a support roll chargeable to a predetermined second potential; and a matrix in the form of a printing circuit, said matrix having supply apertures, each supply aperture having a first inner diameter and being surrounded by an electrically conducting control ring configured to be charged to a predetermined third potential and having a second inner diameter, said third potential being selected to control corresponding supply apertures between an open and closed state, said open state being achieved when said third potential is higher than said first potential and lower than said second potential, and said closed state being achieved when said third potential is lower than said first potential, said second inner diameter of the control ring being at least equal to the first inner diameter of the supply aperture, wherein each electrically conducting control ring is connected directly to a base of said matrix with the second inner diameter of the control ring edge to edge with the supply aperture of the matrix, said matrix and said electrically conducting control rings being covered on upper surfaces and aperture edges with an electrically insulating layer, wherein the electrically insulating layer is applied by an evaporation method and has an electric degradation resistance of about 200 V/μm and is applied in a layer of more than 2 μm for insulating an electric field of +250 V between the feeder roll and the control ring of the matrix;

wherein said feeder roll, said support roll and said matrix are configured to transfer a dry powder from said feeder roll through said supply apertures of the matrix to an object to be printed which is conveyed over said support roll, said powder deposited on the object being fixed by said heat treatment means.

10. The printing apparatus of claim 9, wherein the layer is between 5–10 μm.

11. The printing apparatus of claims 1, wherein the electrically insulating layer is a layer of a polymeric material.

12. The printing apparatus of claim 11, wherein the polymeric material is poly-para-xylene applied in a layer having a predetermined thickness.

13. The printing apparatus of claims 1, wherein the insulating material of the matrix is applied by an evaporation method.

14. A printing apparatus of comprising:

heat treatment means;

a rotatable feeder roll chargeable to a predetermined first potential;

a support roll chargeable to a predetermined second potential; and a matrix in the form of a printing circuit, said matrix having supply apertures, each supply aperture having a first inner diameter and being surrounded by an electrically conducting control ring configured to be charged to a predetermined third potential and having a second inner diameter, said third potential being selected to control corresponding supply apertures between an open and closed state, said open state being achieved when said third potential is higher than said first potential and lower than said second potential, and said closed state being achieved when said third potential is lower than said first potential, said second inner diameter of the control ring being at least equal to the first inner diameter of the supply aperture, said matrix and said electrically conducting control ring being covered on upper surfaces and aperture edges with an electrically insulating layer, wherein the electrically insulating layer has an electric degradation resistance of about 200 V/μm and is applied in a layer of more than 2 μm for insulating an electric field of +250 V between the feeder roll and the control ring of the matrix;

wherein said feeder roll, said support roll and said matrix are configured to transfer a dry powder from said feeder roll through said supply apertures of the matrix to an object to be printed which is conveyed over said support roll, said powder deposited on the object being fixed by said heat treatment means.

15. The printing apparatus of claim 14, wherein the layer is between 5–10 μm.

16. A printing apparatus comprising:

a rotatable feeder roll chargeable to a predetermined first potential;

a support roll chargeable to a predetermined second potential; and a matrix in the form of a printing circuit, said matrix having supply apertures, each supply aperture having a first inner diameter and being surrounded by an electrically conducting control ring configured to be charged to a predetermined third potential and having a second inner diameter, said third potential being selected to control corresponding supply apertures between an open and closed state, said second inner diameter of the control ring being at least equal to the first inner diameter of the supply aperture, said matrix and said electrically conducting control rings being covered on upper surfaces and aperture edges with an electrically insulating layer;

wherein said feeder roll, said support roll and said matrix are configured to transfer a dry powder from said feeder roll through said supply apertures of the matrix to an object to be printed which is conveyed over said support roll, said powder deposited and fixed on the object.

* * * * *